United States Patent [19]

Anderka et al.

[11] Patent Number: 4,863,168

[45] Date of Patent: Sep. 5, 1989

[54] SPACERS FOR USE AS STRING PROTECTORS FOR TENNIS, SQUACH AND BADMINTON RACKETS, AND DEVICE FOR INSERTING THESE PARTS

[76] Inventors: Gerold Anderka, Holsteiner Chaussee 439, D-2081 Ellerbek; Walter Jozat, An der Hudau 2, D-2357 Bad Bramstedt, both of Fed. Rep. of Germany

[21] Appl. No.: 64,323

[22] Filed: Jun. 19, 1987

[30] Foreign Application Priority Data

Jul. 5, 1986 [EP] European Pat. Off. ..... 86109199.9

[51] Int. Cl.[4] ..... A63B 49/00; B65G 59/00; A47F 1/04; B26F 3/06

[52] U.S. Cl. ..... 273/73 D; 221/123; 221/308; 221/250; 221/312 R; 225/93; 225/103

[58] Field of Search ..... 273/73 R, 73 D, 73; 29/811, 239, 816; 206/56; 221/312, 120–308; 225/93, 96.5, 103

[56] References Cited

U.S. PATENT DOCUMENTS

| | | | |
|---|---|---|---|
| 3,009,155 | 11/1961 | Leniz | 221/123 |
| 3,101,477 | 8/1963 | Leniz | 221/268 |
| 3,164,250 | 1/1965 | Paxton | 206/56 |
| 3,846,900 | 11/1974 | Weglage | 29/811 |
| 4,027,371 | 6/1977 | Dischinger | 29/811 |

FOREIGN PATENT DOCUMENTS

| | | | |
|---|---|---|---|
| 2521855 | 5/1975 | Fed. Rep. of Germany . | |
| 3329150 | 8/1983 | Fed. Rep. of Germany | 273/73 R |
| 1359709 | 3/1964 | France | 221/268 |
| 2310779 | 5/1976 | France . | |

*Primary Examiner*—Edward M. Coven
*Assistant Examiner*—Gary Jackson
*Attorney, Agent, or Firm*—Marshall, O'Toole, Gerstein, Murray & Bicknell

[57] ABSTRACT

A dispenser for the insertion of spacers between the strings of tennis, squash and badminton rackets includes a body having a delivery groove formed therein. The delivery groove is adapted to receive an interconnected strip of spacers and dispense the spacers individually between intersecting strings of a racket. The delivery groove may include a raised portion to allow the strip of spacers to be manually advanced within the device and a pair of prong-like projections for separating a pair of intersecting racket strings. The prong-like projections may have an abutment edge for positioning the interconnected strip of spacers.

12 Claims, 4 Drawing Sheets

SPACERS FOR USE AS STRING PROTECTORS FOR TENNIS, SQUACH AND BADMINTON RACKETS, AND DEVICE FOR INSERTING THESE PARTS

TECHNICAL FIELD OF THE INVENTION

The invention relates to spacers for use as string protectors for tennis, squash and badminton rackets, and to a device for inserting these parts between two intersecting strings of a set of strings, the square spacers having grooves running at right angles to one another and adapted to the diameter of the strings. The container forming a supply magazine for the spacers is provided with a fork-shaped device for spreading the strings apart.

BACKGROUND OF THE INVENTION

Such spacers and corresponding devices are known, for example, from DE-PS 25 21 855. In this patent specification a device for inserting intermediate members between two intersecting strings of a set of tennis racket strings is described, the intermediate members being formed as guide cross-pieces (cross-blocks) with pairs of arms running at right angles to one another and partly embracing the strings, and the body of the device holding a supply magazine for the intermediate members, having a handle and having fork-shaped prongs arranged at its front end to force the intersecting strings apart.

The distinctive feature of this device is said to be that the supply magazine is connected with a position between the prongs via a positioning device for the intermediate members and a guide passage, and that a means for delivering the members, through which means the last section of the guide passage adjacent to the prongs runs, is linked pivotably to the body of the device next to the prongs, and is traversed by a slit crossing the last section, into which a tongue rigidly connected to the device body projects so that the last section of the guide passage is blocked or free depending on the position in which the delivery means is pivoted.

It is a disadvantage of this device that the guide cross pieces must be specifically arranged before they can slide into the delivery passage. It is not unusual for individual cross-pieces to jam so that simply slipping into the delivery passage becomes impossible. In addition the construction of the device is very difficult and thus also very dear.

Another form, which is an improvement on the solution described in DE-PS 25 21 855, is known from DE-OS 33 29 150.

In the device described in this published specification discs, preferably annular-shaped, are pushed out of a storage container by means of a pusher housed in a delivery passage, the operating part of which extends through the cover, and between two strings that are forced apart by prong-like projections of the device.

In doing this, care must always be taken that there is only one disc in the delivery passage, as otherwise a blockage, i.e. wedging of the discs, can occur. For more reliable transport of the discs it is necessary to push the pusher right back after each operation of the lever action, so that a new disc can slide down. To provide the normal striking area of a tennis racket with spacers, about 120 discs must be pushed between the strings.

This manipulation requires a relatively large amount of effort and the device and its assembly are inconvenient.

OBJECT OF THE INVENTION

The object of the invention is thus to provide spacers and a device of the kind described above by which the spacers in the storage region of the device can be brought into the correct position between the intersecting strings in the simplest possible way while spreading the intersecting strings apart, without holding or adjustment by hand being necessary.

SUMMARY OF THE INVENTION

This problem is solved, according to the invention, by forming the spacers as a strip provided with breakage points.

The device for inserting these spacers as string protectors between two intersecting strings, which is directly related to the spacers, has the distinquishing feature that a raised part is provided in the delivery track over which the strip, which projects through an opening in the cover, slides and is pushed into the insertion position.

What is appealing about this device is its simplicity of form, particular features of which are apparent from the drawings and description contained herein.

In tennis tournaments the players can always be seen during the changes of ends adjusting the strings of their rackets and trying, with the aid of a special tool, to replace spacers that have been lost during play. How troublesome this procedure is can be seen from the fact that the players are not able to insert more than 2 or 3 spacers during a break. Because of the high tension with which the strings lie against one another the use of some device is unavoidable.

For this purpose the solution according to the invention is particularly useful, since with this easyto-use device the strings can be separated, the spacers pushed between them and the spreading of the strings released again, all with a single hand action. A further advantage is that this device can also be used as a package for the strip of spacers.

BRIEF DESCRIPTION OF THE DRAWINGS

The invention will now be explained in more detail with reference to the drawings showing an exemplary embodiment, in which.

DETAILED DESCRIPTION OF A PREFERRED EMBODIMENT OF THE INVENTION

Figure 4:
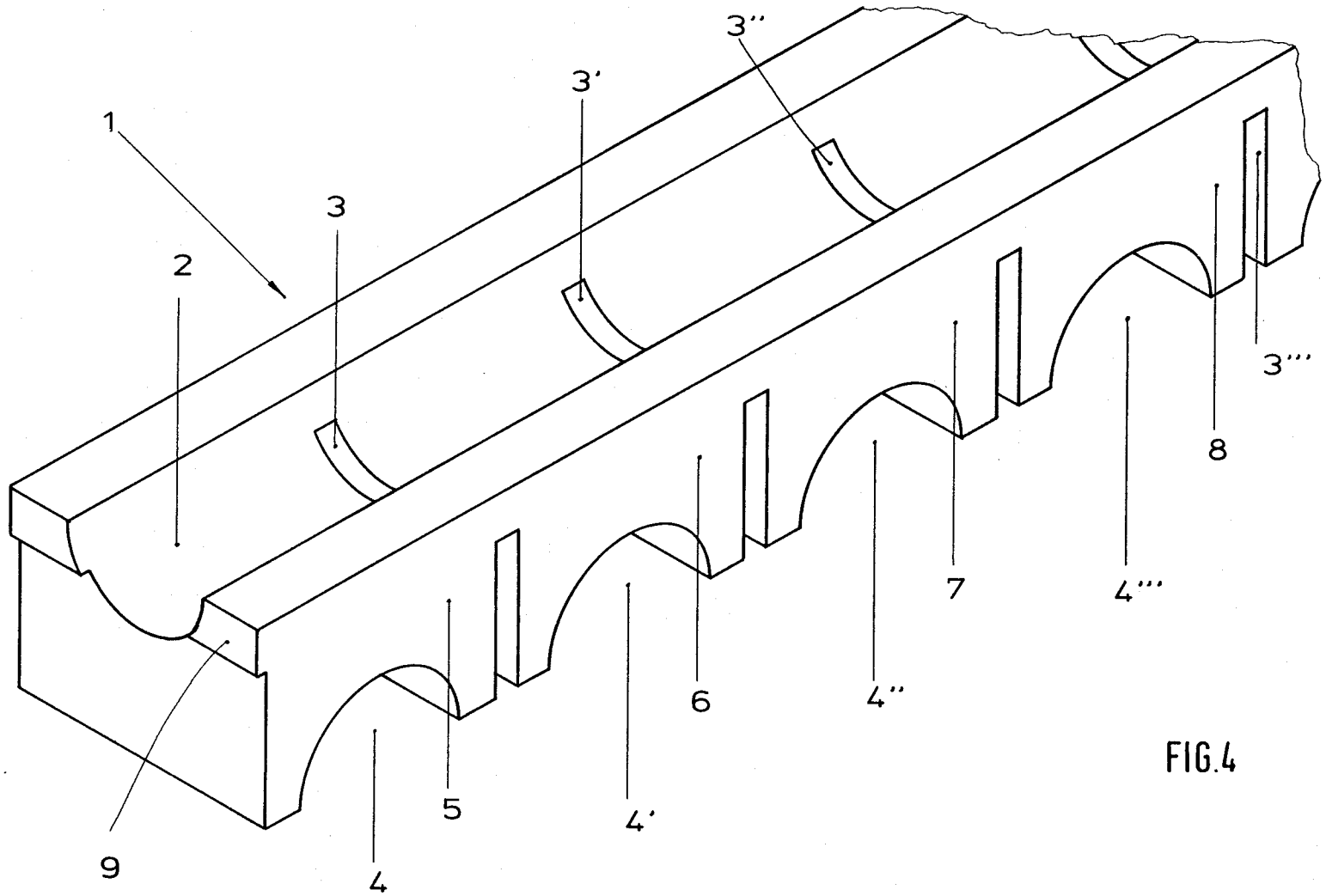
FIG. 4 shows, in perspective, spacers in the form of a strip.

As can be seen in particular from FIG. 4, the spacers (5, 6, 7, 8) consist of a strip-shaped piece (1), provided with a groove (2) running longitudinally of the strip and preferably semicircular in section. On the opposite side of the strip recesses (4, 4', 4'', 4''') are provided at right angles to the groove (2), which also have a semicircular section, the radius being approximately equal to that of the string. So that the individual spacers (5, 6, 7, 8) can be readily separated from one another, cuts (3, 3', 3'', 3''') are made in the material of the strip between the semicircular recesses to such a depth that a thin fracture edge remains. These cuts are preferably wedge-shaped, though obviously a rectangular shape is also possible.

Figure 1:
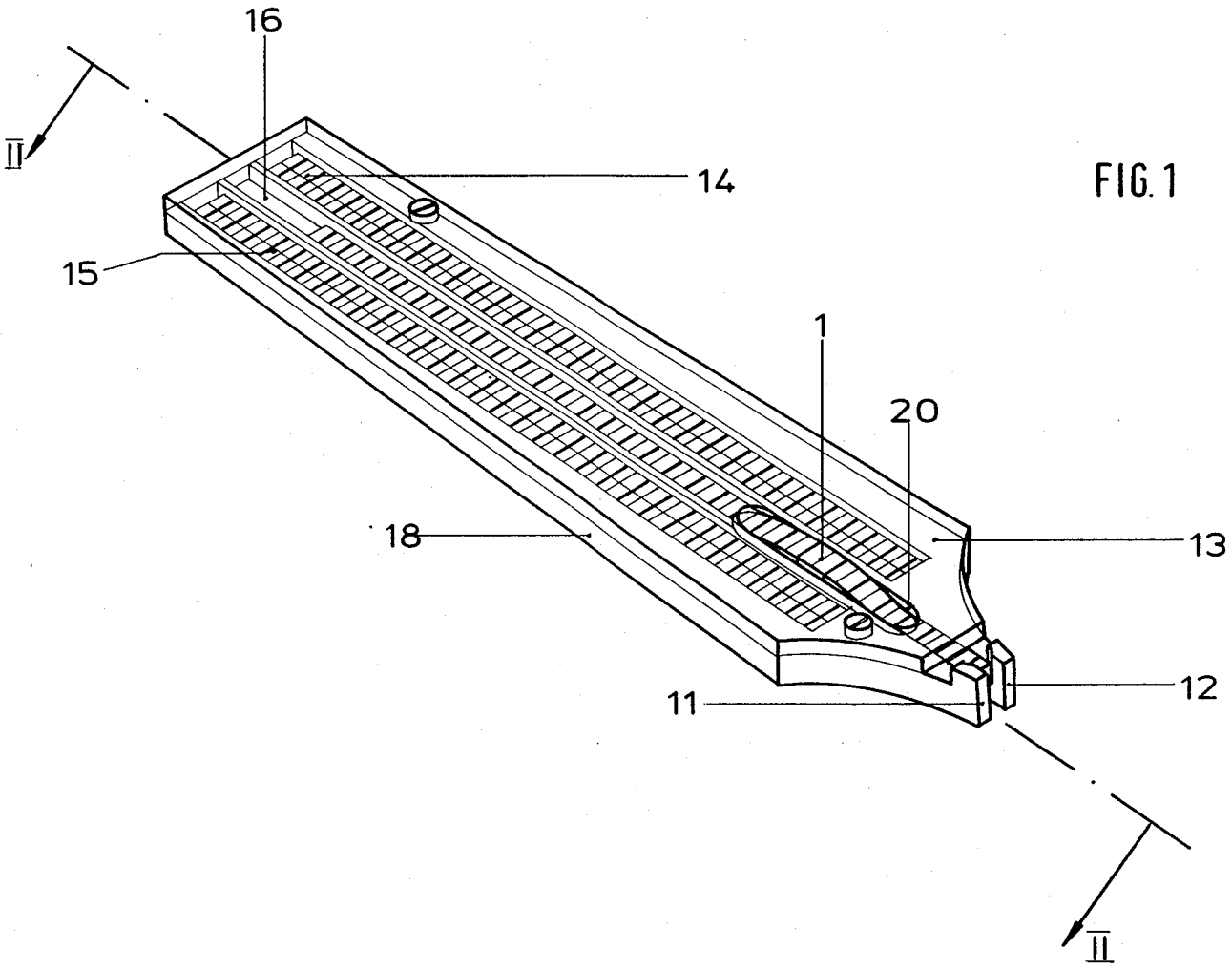
FIG. 1 shows a perspective view of the device.

The other figures relate to the device for inserting spacers. Its form can be seen from the perspective view in FIG. 1. The body (18) receives the delivery groove (16) that ends in the prong-like projections (11, 12). Into this delivery groove (16) is inserted the main strip (1) which, because of the hump-shaped raised portion (19) in the delivery groove, projects through the opening (20) in the cover (13). This cover (13) is connected to the body (18) by screws, welding, adhesion or the like. Preferably it consists of transparent plastic so that the user can see how many spacers still remain.

Since about 100–120 spacers are needed for a tennis racket, the whole strip must be broken up into, for example, 4 and 5 separate strips if the device is not to become too awkward. These grooves for replacement strips are indicated by the reference numerals (14, 15) in FIG. 1. In this Figure the course of the cut shown in FIG. 2 can also be seen.

Figure 2:
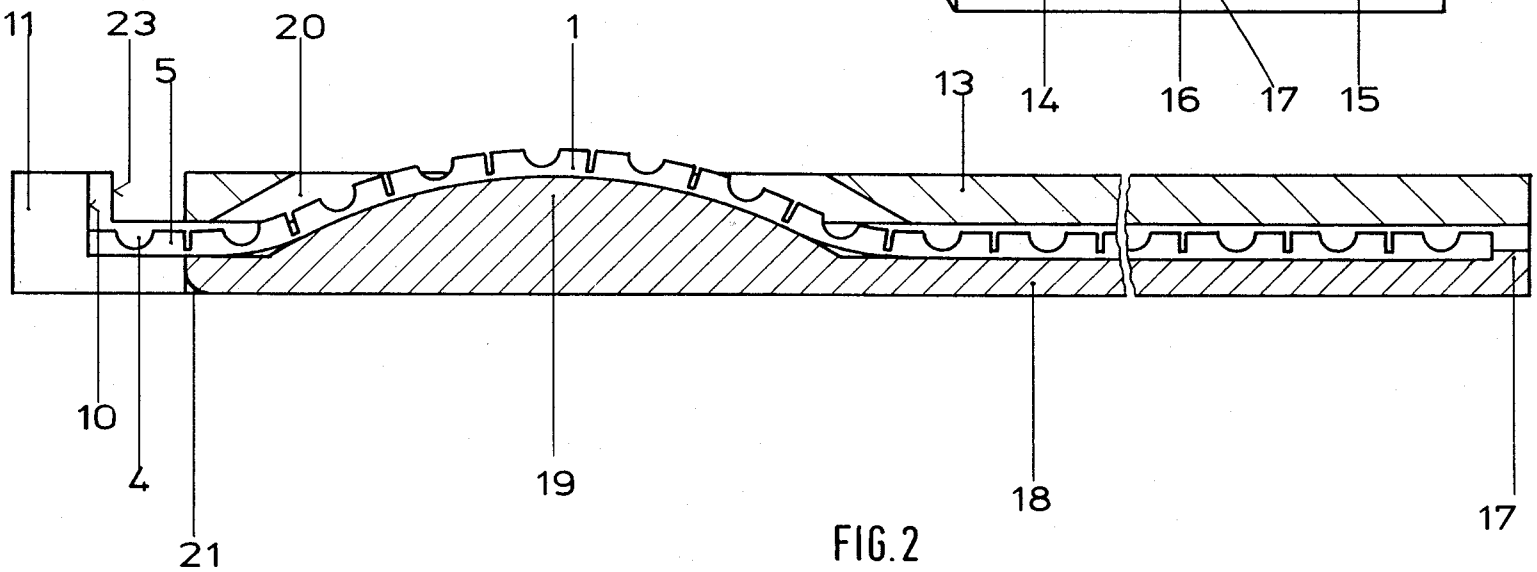
FIG. 2 shows a section corresponding to the line II—II.

It can be clearly seen from FIG. 2 how the strip of spacers is arranged. The prong-shaped projections (11, 12) are provided with an abutment edge against which the spacer (5) is pushed after the two intersecting strings have been forced apart. The distance between the abutment edge (10) and the middle of the spacer is chosen so that on releasing the spreading the upper string is forced into the groove (4) and the lower string into the groove (2).

Figure 3:
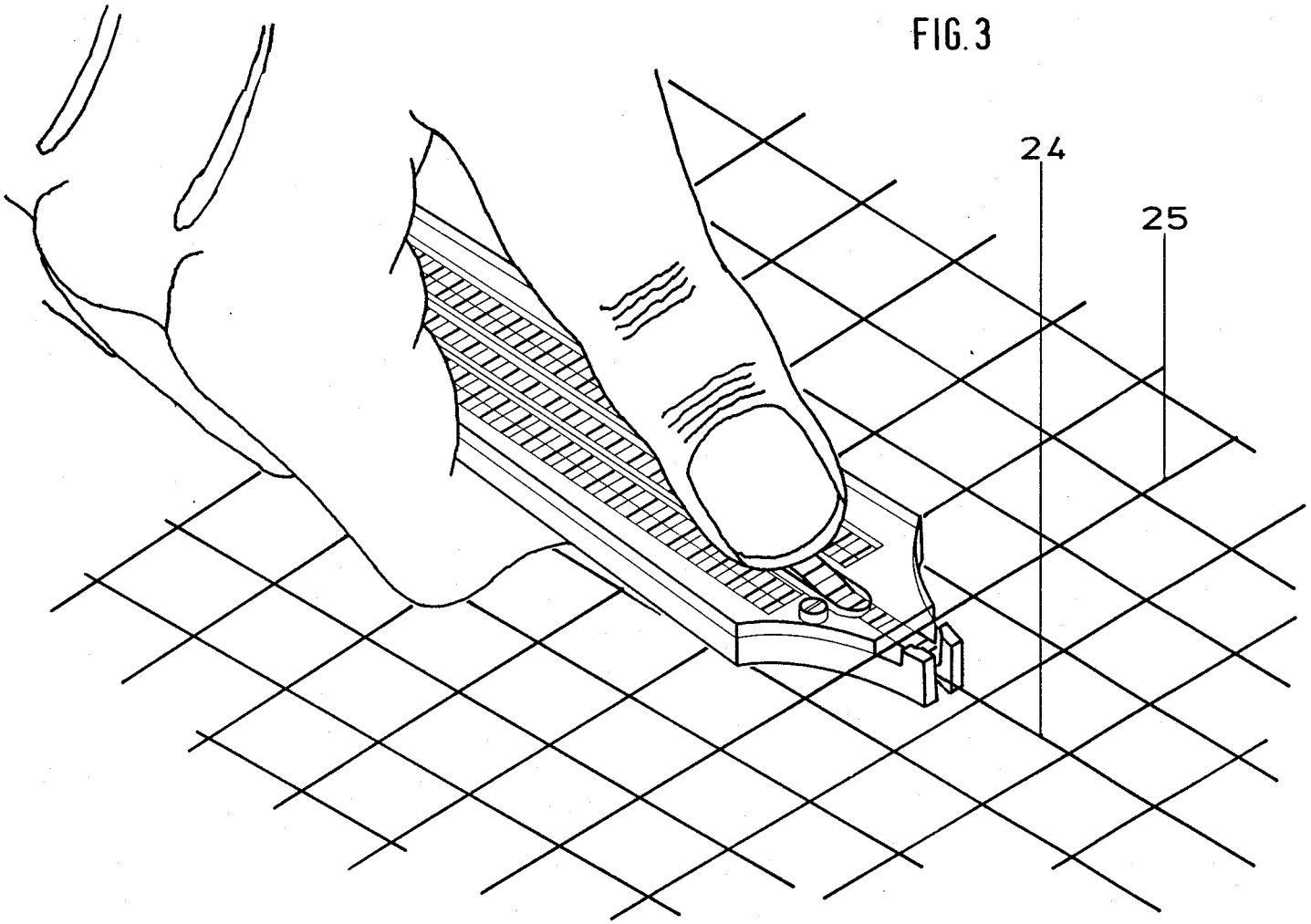
FIG. 3 shows in perspective the use of the device on a set of strings.

As shown in FIG. 3, the device is supported on the string (24). To avoid damage to the string by a sharp edge, the supporting edge is provided with a radius (21). After the device has been pushed under a cross string (25) and pressed down, the device rolls on this radius. This radius can of course also be provided with a hollow groove to improve centering. From FIG. 3 it also can be seen how the device is used. The prong-shaped projections (11, 12) are pushed under the string (25), so that this string lies up against the abutment edge (23). If the back of the device is now pressed down, it is supported with the radius (21) on the lower string (24), and the strings (24, 25) are forced apart.

After the strings have been spread, the strip (1) projecting through in the opening (20) in the cover is pushed forward with the thumb until the spacer (5) comes up against the abutment edge (10). After raising the device, the spacer (5) breaks off at the breaking point (9) and is clamped between the strings (24, 25). Individual spacers cannot fall out of the device or be lost as they are inserted between two strings, since the breaking point only fractures when the tension is released. The cover (13) covering the main string and the reserve strings can be screwed, glued, welded or otherwise fastened on.

Figure 5:
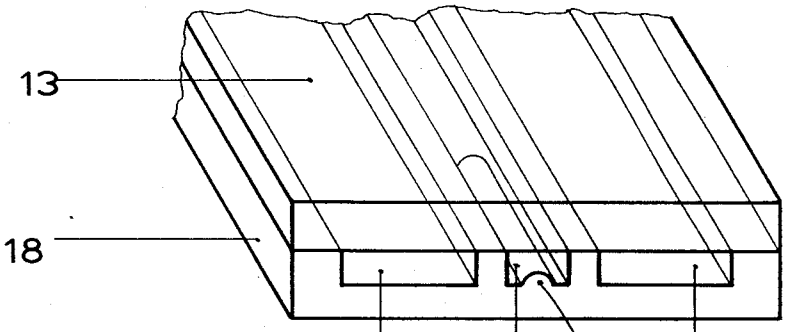
FIG. 5 shows a view of part of the back of the device.

The back view of the device is shown in FIG. 5. This figure shows the lower part (18) with the storage grooves (14, 15) and the delivery groove (16) and the guide ridge (17). This guide ridge (17) serves to prevent the replacement strip from being pushed in upside down. It has the same radius as a tennis string or as the longitudinal groove in the strings of spacers.

The longitudinal groove (2) and the transverse grooves (4, 4', 4'', 4''') can also have a polygonal form. Such a form can compensate for differences in diameter between different strings.

In the rear part of the device one or more openings can be provided in the cover to facilitate access to the reserve strips from the grooves (14, 15).

What is claimed is:

1. A dispenser for dispensing spacers used as string protectors, said dispenser comprising:

a body;

a delivery groove formed in the body, the delivery groove having a floor and side walls, a portion of the floor being raised with respect to the side walls so as to form a raised portion; and a cover over the delivery groove, the cover having an opening approximately adjacent the raised portion of the delivery groove.

2. In combination, a dispenser for dispensing spacers used as string protectors, said dispenser comprising:

a body having a pair of prong-like projections with an abutment edge for positioning a connected strip of spacers;

a delivery groove formed in the body, the delivery groove being adapted to receive a connected strip of spacers and being substantially uninterrupted, the delivery groove being aligned to deliver an end of the strip of spacers between the prong-like projections to the abutment edge; and a cover over the delivery groove, the cover having an opening to facilitate the manual advancement of a strip of spacers within the delivery groove.

3. In combination, a device for inserting spacers as string protectors for tennis, squash and badminton rackets, the device comprising:

a dispenser comprising:

a body;

a delivery groove formed in the body, a portion of the delivery groove being substantially raised; and a cover over the delivery groove, the cover having an opening approximately adjacent the raised portion of the delivery groove; and a plurality of spacers, the spacers being provided in a strip in the delivery groove, the strip being provided with breakage points and being slidable over the raised portion of the delivery groove whereby one of the spacers may be pushed to an insertion position in the dispenser.

4. A device for inserting spacers, according to claim 3, wherein a guide ridge is provided in the delivery groove for orientation of the strip in the correct position.

5. A device for inserting spacers, according to claim 3 or 6, wherein two storage recesses are provided in the body of the dispenser, each recess being adapted to receive at least one reserve strip.

6. A device for inserting spacers, according to claim 3, wherein the delivery groove terminates near two prong-like projections formed in the body of the dispenser.

7. A device for inserting spacers, according to claim 6, wherein the cover ends far enough from the prong-like projections for a spacer to be freely removed.

8. A device for inserting spacers, according to claim 3, wherein the distance between the bottom of the delivery groove and the underside of the cover is only slightly more than the height of the strip of spacers.

9. A device for inserting spacers, according to claim 3, wherein the form of the deliverygroove for the strip of spacers is such that a spacer partly overlaps the two racket strings in the correct position when the strings are spread apart.

10. A device for inserting spacers, according to claim 3, wherein the strip is provided with semicircular section recesses transverse to the groove and wherein cuts forming breakage points are made in the strip.

11. A device for inserting spacers, according to claim 3 or 6, wherein the breakage points are cuts having a wedge-shaped section.

12. A device for inserting spacers, according to claim 3, wherein the breakage points are cuts having a rectangular section.

* * * * *